US007039957B2

(12) United States Patent
Park

(10) Patent No.: US 7,039,957 B2
(45) Date of Patent: May 9, 2006

(54) CAP WITH TUNNEL SHAPE BAND

(75) Inventor: Boo Yl Park, Seoul (KR)

(73) Assignee: Dada Corp., Seoul (KR)

( * ) Notice: Subject to any disclaimer, the term of this patent is extended or adjusted under 35 U.S.C. 154(b) by 226 days.

(21) Appl. No.: 10/261,681

(22) Filed: Oct. 2, 2002

(65) Prior Publication Data

US 2004/0019954 A1 Feb. 5, 2004

(30) Foreign Application Priority Data

Aug. 5, 2002 (KR) ..... 2002-23386

(51) Int. Cl.
*A42C 5/00* (2006.01)

(52) U.S. Cl. ..... 2/181; 2/195.1

(58) Field of Classification Search ..... 2/195.1–195.3, 2/181.4, 181, 175.1; 139/394 R, 387 R, 139/421, 423
See application file for complete search history.

(56) References Cited

U.S. PATENT DOCUMENTS 4,274,157 A 6/1981 Boden
4,481,681 A 11/1984 Hankin
5,613,248 A 3/1997 Young
5,632,046 A 5/1997 Green et al.
5,715,540 A 2/1998 Cho
5,920,910 A 7/1999 Calvo
5,966,742 A 10/1999 Cunliffe
5,983,398 A 11/1999 Kronenberger
6,016,572 A * 1/2000 Park ..... 2/195.2
6,067,658 A * 5/2000 Cho ..... 2/181
6,115,844 A * 9/2000 Cho ..... 2/181
6,119,273 A * 9/2000 Cho ..... 2/195.3
6,199,213 B1 3/2001 Whang
6,347,410 B1 2/2002 Lee
6,493,880 B1 * 12/2002 Lo ..... 2/195.2
6,546,563 B1 * 4/2003 Young ..... 2/181
6,928,659 B1 * 8/2005 Lee ..... 2/175.1
2003/0177565 A1 * 9/2003 Park ..... 2/181.4

* cited by examiner

*Primary Examiner*—Katherine M. Moran
(74) *Attorney, Agent, or Firm*—Mayer, Brown, Rowe & Maw LLP

(57) ABSTRACT

A baseball-style cap having a crown portion made of multiple panels, a visor part which is attached to the front part of the crown portion and a headband attached to and extending around the lower inside edge of the crown portion. The headband is a band of two-ply elastic yarn material woven in a tubular or tunnel shape that contains no polyurethane. With this construction good perspiration absorbency is obtained without imposing undue elastic pressure on the wearer.

13 Claims, 2 Drawing Sheets

CAP WITH TUNNEL SHAPE BAND

BACKGROUND OF THE INVENTION

1. Field of the Invention

The present invention is related to the field of caps having visors and, more particularly, to a baseball-style cap with a tunnel-shape band to automatically fit the wearer's head while remaining comfortable for a long period of time.

2. Description of the Related Art

A baseball style cap generally includes a crown main body, a visor portion that is secured to the forward edge of the crown and extends outwardly therefrom, a headband attached to the lower part of the inside of the crown, and a size controller attached to an underside of the rear of the cap. The size of the cap is adapted to fit the wearer's head using the size controller when the cap is worn.

Efforts have been made to produce a baseball-style cap that can fit varying head sizes without the need for a separate size controller structure. For example, U.S. Pat. No. 6,016,572 discloses a cap having a crown part which is composed of multiple ply cloth of non-elastic material forming a number of gores, at least some of which are joined together by elastic material. The headband around the lower edge of the crown is also elastic so that the cap fits the wearer's head by stretching of the elastic material in the crown and the headband. It has been found, however, that such a cap exerts pressure against the wearer's head which can become uncomfortable after the cap is worn for an extended period of time.

Accordingly, a need exists for a free-size cap having a headband that can accommodate varying head sizes without undue pressure so as to remain comfortable for the wearer over extended time periods.

SUMMARY OF THE INVENTION

In view of the foregoing, one object of the present invention is to provide a cap with a headband that can stretch to accommodate different head sizes without a separate size controlling mechanism and without exerting undue pressure on the head when worn.

Another object of the present invention is a cap providing good ventilation for the wearer's head through a sweat absorbing, tunnel-shaped headband.

A further object of the invention is a cap having a headband made of two-ply fabric without polyurethane.

Yet another object of the invention is a cap having a crown made with or without polyurethane or spandex material.

In accordance with these and other objects, the present invention is directed to a cap having a crown portion made of multiple panels, a visor part which is attached to the front part of the crown portion and a headband attached to and extending around the lower inside edge of the crown portion. The headband is a band of two-ply elastic yarn material woven in a tubular or tunnel shape that contains no polyurethane. With this construction good perspiration absorbency is obtained without undue elastic pressure on the wearer.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
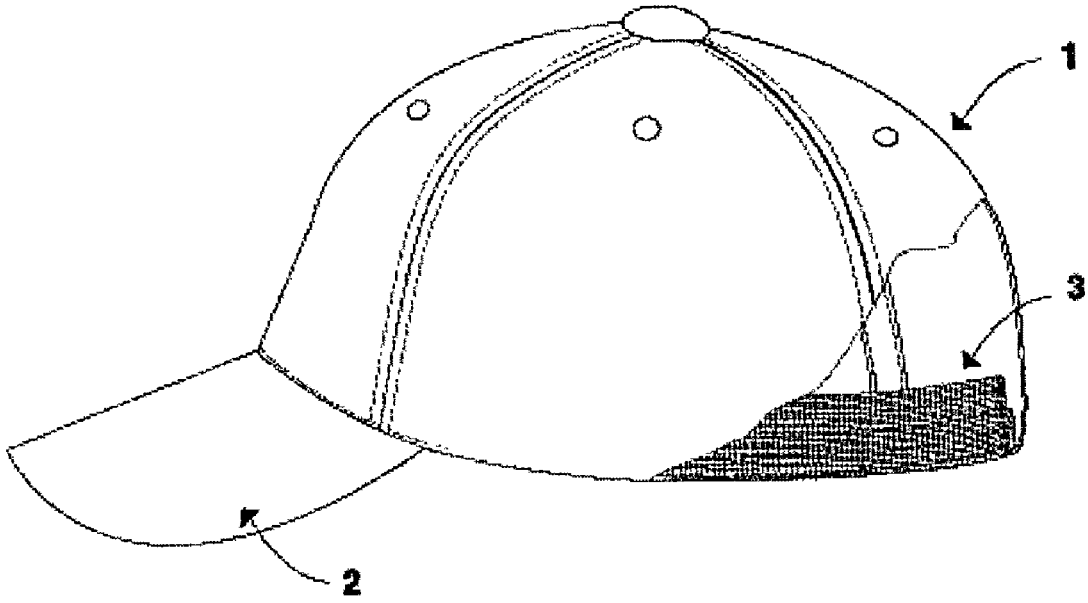
FIG. 1 is a side view illustrating the cap according to the present invention with a partial cross-section illustrating the headband thereof.

In describing a preferred embodiment of the invention illustrated in the drawings, although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

Figure 2:
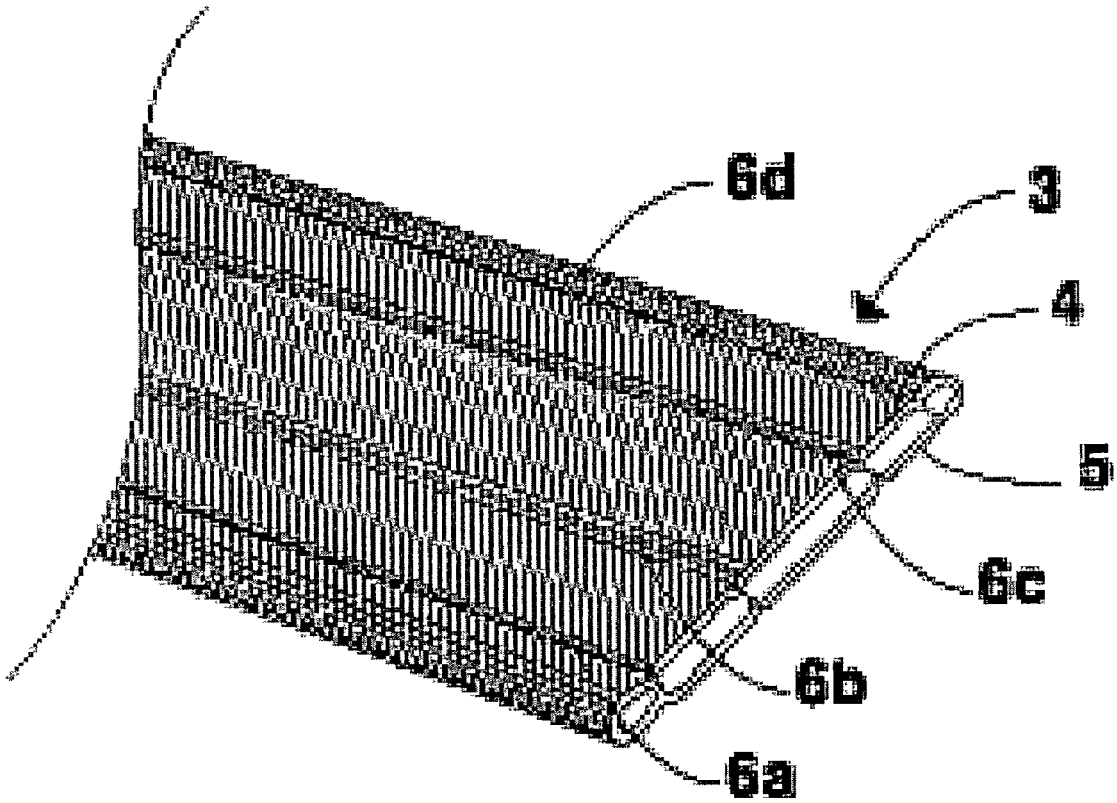
FIG. 2 is a perspective view of the tunnel-shaped headband according to the present invention.

In accordance with a preferred embodiment of the present invention, the present invention is directed to a cap having a tunnel-shaped woven headband as shown in FIGS. 1 and 2.

As illustrated in the FIG. 1, the cap includes a plurality of panels forming a crown main body, generally designated by the reference numeral 1, a visor portion 2 that is secured to the forward edge of the crown 1, and a headband 3 that is secured to the lower peripheral edge of the interior of the crown 1. The panels 4 can be made of knitted material containing no polyurethane. Alternatively, the panels may be made of fabric materials that contain polyurethane or spandex. The headband 3 is a band of two-ply material containing no polyurethane and woven into a tubular or tunnel shape. As the cap is constructed without a separate size controlling element, upon wearing thereof the fabric of the crown portion and the fabric of the headband are stretched as necessary to fit the wearer's head. The absence of polyurethane in the headband and the tunnel-shape thereof ensures that the cap can be worn comfortably for an extended period with no feeling of pressure on the wearer's head.

As shown in FIG. 2, the headband is woven of elastic yarn. The tunnel shape is created by the two plys 4, 5 secured to one another with sewing lines 6*a*, 6*b*, 6*c*, 6*d* at spaced intervals. The sewing lines 6*a*, 6*b*, 6*c*, 6*d* can create a plurality of substantially parallel tunnels as shown, with the stitching ensuring a close relationship between the two plys 4, 5. The elastic yarn may be readily stretched in the direction of the periphery of the crown to accommodate various head sizes. The stretching of the headband is possible not only due to the elastic nature of the yarn, but also due to the way of weaving the plys sparsely in a low density so that the resulting band is not tightly woven.

In a preferred construction, the headband is woven with two ply fabric 4, 5 by arranging 400 bundles in warp-way and 2 bundles in weft-way, each bundle being consisted of 48 high elastic yarn and each yarn being 170D. When measuring weight of a thread which is 9 Km long, the thread is 1 Denier if the weight is 1 gram. If the weight of the thread is 170 grams, then it is 170D (Denier). The resulting manufactured tunnel-shaped headband stretches 25% to 45% under a weight of 1.8 Kg after 10 seconds, and demonstrates 0.4% to 3% of residual rate within 30 seconds upon removal of the weight. When the cap is worn, the tunnel-shaped headband will therefore naturally stretch to fit the wearer's head size. The tunnel shaping of the band also provides excellent ventilation effect for the wearer's head, absorbing and wicking moisture away from the head, and thereby enhancing the wearer's comfort.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the tunnel-shaped headband may be incorporated into hats and caps of other styles. Therefore, it is not desired to limit the invention to the specific examples disclosed or the exact construction and operation shown and described. Rather, all suitable modifications and equivalents may be resorted to, falling within the scope of the invention.

What is claimed is:

1. A baseball-style cap comprising:

a crown main body having a plurality of panels;

a visor portion secured to a forward portion of a peripheral edge of said crown main body and extending outwardly therefrom;

a headband attached along said peripheral edge of said crown main body, said headband woven of two-ply material to have a tunnel shape and containing no polyurethane, wherein said headband is made of an elastic yarn such that said headband stretches 25% to 45% under a weight of 1.8 Kg after 10 seconds, and demonstrates 0.4% to 3% of residual rate within 30 seconds upon removal of the weight, wherein said headband is woven with 400 bundles of yarns in warp-way and 2 bundles of yarns in weft-way, each bundle consisting of 48 elastic yarns and each yarn being 170D.

2. The cap as set forth in claim 1, wherein said plurality of panels forming said crown main body are made with knitted material containing no polyurethane.

3. The cap as set forth in claim 1, wherein said plurality of panels forming said crown main body are made with fabric material containing polyurethane.

4. The cap as set forth in claim 1, wherein said plurality of panels forming said crown main body are made with fabric material containing spandex.

5. The cap as set forth in claim 1, wherein said headband includes a plurality of sewing lines defining a plurality of substantially parallel tunnels extending around said peripheral edge.

6. A baseball-style cap comprising:

a crown main body having a plurality of panels;

a visor portion secured to a forward portion of a peripheral edge of said crown main body and extending outwardly therefrom;

a headband attached along said peripheral edge of said crown main body, said headband woven of two-ply material containing no polyurethane to have a tunnel shape and being woven with 400 bundles of yarns in warp-way and 2 bundles of yarns in weft-way, each bundle consisting of 48 elastic yarns and each yarn being 170D.

7. The cap as set forth in claim 6, wherein said plurality of panels forming said crown main body are made with fabric material containing no polyurethane.

8. The cap as set forth in claim 6, wherein said plurality of panels forming said crown main body are made with fabric material containing polyurethane.

9. The cap as set forth in claim 6, wherein said plurality of panels forming said crown main body are made with fabric material containing spandex.

10. The cap as set forth in claim 6, wherein said headband includes a plurality of sewing lines defining a plurality of substantially parallel tunnels extending around said lower peripheral edge.

11. A baseball-style cap comprising:

a crown main body having a plurality of panels;

a visor portion secured to a forward portion of a peripheral edge of said crown main body and extending outwardly therefrom;

a headband attached along said peripheral edge of said crown main body and woven of two-ply material to have a tunnel shape, said material containing no polyurethane and being made of an elastic yarn such that said headband stretches 25% to 45% under a weight of 1.8 Kg after 10 seconds, and demonstrates 0.4% to 3% of residual rate within 30 seconds upon removal of the weight, wherein said headband is woven with 400 bundles of yarns in warp-way and 2 bundles of yarns in weft-way, each bundle consistina of 48 elastic yarns and each yarn being 170D.

12. A headband for use with a cap, said headband woven of two-ply material to have a tunnel shape and being woven with 400 bundles of yarns in warp-way and 2 bundles of yarns in weft-way, each bundle consisting of 48 elastic yarns and each yarn being 170D.

13. The headband as set forth in claim 12, wherein said headband contains no polyurethane and stretches 25% to 45% under a weight of 1.8 Kg after 10 seconds, and demonstrates 0.4% to 3% of residual rate within 30 seconds upon removal of the weight.

* * * * *